US006290781B1

(12) United States Patent
Brouillet, Jr.

(10) Patent No.: US 6,290,781 B1
(45) Date of Patent: Sep. 18, 2001

(54) METHOD FOR REMOVING DEPOSITS FROM HARD SURFACES

(75) Inventor: Richard Brouillet, Jr., Paxton, MA (US)

(73) Assignee: Pamela Brouillet, Paxton, MA (US)

( * ) Notice: Subject to any disclaimer, the term of this patent is extended or adjusted under 35 U.S.C. 154(b) by 0 days.

(21) Appl. No.: 08/353,622

(22) Filed: Dec. 12, 1994

(51) Int. Cl.[7] ..... A47L 1/02; B08B 1/04

(52) U.S. Cl. ..... 134/7; 134/6; 134/3; 15/97.1; 15/103; 15/230.17

(58) Field of Search ..... 134/6, 7, 3, 4; 15/97.1, 103, 230.17

(56) References Cited

U.S. PATENT DOCUMENTS 4,502,892 * 3/1985 Westermann et al. ..... 134/6
5,183,000 * 2/1993 Burks ..... 114/222
5,192,460 * 3/1993 Thomas et al. ..... 134/3

FOREIGN PATENT DOCUMENTS

WO84/03459 * 9/1984 (WO) ..... 134/6

* cited by examiner

*Primary Examiner*—Zeinab El-Arini
(74) *Attorney, Agent, or Firm*—Elizabeth E. Nugent; Choate, Hall & Stewart

(57) ABSTRACT

A method for cleaning a mirrored glass. The method includes affixing a pad to a portable, power tool; applying a composition containing an abrasive to the pad; applying the pad to the mirrored glass surface; operating the tool in a rotary motion at high speed until the mirrored glass surface is clean; and removing any excess composition from the mirrored glass surface.

A composition for use in cleaning mineral deposits off mirrored glass surfaces and includes a non-toxic, biodegradable solution having a pH less than 7.0 in combination with an abrasive selected from the group consisting of ground pumice stone, calcium carbonate, aluminum oxide, and diatomaceous earth. A preferred acid composition has a pH of about 4.0, and contains an abrasive with a particle size between about 3 to about 5 microns.

8 Claims, No Drawings

METHOD FOR REMOVING DEPOSITS FROM HARD SURFACES

BACKGROUND OF THE INVENTION

This invention relates to a method for removing mineral and other deposits from hard surfaces such as glass, tile and the like and compositions for such use.

In the many parts of the country, it is common to find water containing calcium, magnesium or iron (II)ions in solution. Calcium ions derived from the passage of natural waters through and over limestone are the most common metallic ions in "hard water". Under certain conditions, insoluble salts of these metals precipitate.

Hardness in water is objectionable for several reasons. Deposits of insoluble metallic salts may be precipitated when water is heated or when soaps are added, prior to cleaning of the surface. The deposition of insoluble salts is also especially problematic when hard water comes into contact with mirrored glass and tile surfaces. In particular, mirrored glass is used in supermarket produce cases to reflect the vegetables and to enhance the display. A misting system is commonly used in produce cases to automatically spread water onto vegetables several times each hour to help retain their freshness. Typical produce cases keep refrigerated air constantly moving over the produce and over the mirrored glass surface. The moving air causes some of the water to evaporate between the misting cycles and leads to deposition of the minerals and other foreign matter on the mirrored surface. After several weeks this buildup is difficult to remove with conventional cleaning products and techniques. The buildup gives the mirror the appearance of being dirty and, because of the proximity of fresh produce, it presents an unacceptable situation with respect to the customers' perceptions of the store and its environs.

Various methods have been employed to prevent this problem by attempting to remove the minerals from the water using ultrafiltration, reverse osmosis and deionization systems. These methods are only partially successful because they cannot remove all of the minerals economically and thoroughly. Other methods such as removing the mirrors from the supermarket produce case entirely and cleaning them with acid has proven to be costly and hazardous to the health of the personnel. Attempts to remove the deposits (i.e. scale) with steel wool typically damage the glass surface.

SUMMARY OF THE INVENTION

It is an object of the present invention to provide a simple, safe and effective method for cleaning hard surfaces such as mirrored glass of supermarket produce cases, free of accumulated deposited materials.

It is a further object of the present invention to provide a method for cleaning these hard surfaces using readily available materials.

It is additional object of the present invention to provide a method of cleaning hard surfaces which is effective in removing minerals and other deposits while avoiding damage to the hard surfaces themselves.

It is yet another object of the present invention to provide a safe and a effective composition for use in cleaning these hard surfaces that is non-toxic to food produce.

A method for cleaning a mirrored glass includes affixing a pad to a portable, power tool; applying a composition containing an abrasive to the pad; applying the pad to the mirrored glass surface; operating the tool in a rotary motion at high speed until the mirrored glass surface is clean; and removing any excess composition from the mirrored glass surface. Preferably, the pad is an industrial-grade scouring pad and the composition is an acidic composition having a pH less than 7.0. Preferably, the power tool has a rotary motion ranging from between about 9,000 to about 13,000 revolutions per minute.

A composition for use in cleaning mineral deposits off mirrored glass surfaces comprises a non-toxic, biodegradable solution having a pH less than 7.0 in combination with an abrasive selected from the group consisting of ground pumice stone, calcium carbonate, aluminum oxide, and diatomaceous earth. Another composition for use for removing minerals from mirrored glass surfaces comprises an aqueous solution of citric acid, pumice powder and talc in an amount sufficient to provide an abrasive composition having the consistency of putty. A preferred acid composition has a pH of about 4.0, and contains an abrasive selected from the group consisting of ground pumice stone, calcium carbonate, aluminum oxide, and diatomaceous earth. The most preferred abrasive has a particle size between about 3 to about 5 microns.

DETAILED DESCRIPTION OF THE INVENTION

It will be appreciated that the present method is applicable to hard surfaces such as ceramic tile, glassed shower doors and the like. Nevertheless, the present specification will be directed to the use of the method and compositions to remove minerals and other deposits from mirrored glass in supermarket produce cases.

The practice of the method of this invention requires the use of commonly available polyester cleaning pads, in combination with common rotary or random orbit, hand held polishing and sanding power tools. The preferred pads are scouring pads and are normally made from synthetic nylon or other polymer which provides a roughened surface for removing accumulations of minerals and other deposits from hard surfaces. The preferred scouring pads are available in a variety of shapes and thicknesses, although white pads are preferred because they do not contain any dye. Examples of polyester pads are "Scotch Brite" No. 9030 and No. 98, manufactured by the 3M Building Surface and Cleaning Product Division, Saint Paul, Minn.

It may be necessary to attach the scouring pad to a backup pad and this backup pad may be any conventional rubber pad commonly used in conjunction with hand-held buffer/polishers or disk sanders. Preferably, the method requires the use of the scouring pads made from woven polyester fiber, the spaces between the fibers allowing the materials that are from the surface to migrate away from the work area. The thickness of the pad is preferably about one half inch or less. A thicker pad has a tendency to shear at the center, especially when using a random orbit power tool. Woven cloth, felt, foam rubber, and other soft polishing materials may also be used.

Most preferably, the hand-held power tool is a random orbit tool that will rotate at between about 9,000 to about 13,000 rpm. Lower speeds are acceptable but will slow the removal process. The random orbit action allows high operating speed without spraying any cleaning composition away from the work area. The power tool also includes a device or attachment for engaging the scouring pad. It is most preferred that part of the tool that comes in contact with the work surface comes equipped with a Velcro®-type surface or have Velcro® attached to its surface so that the preferred woven polyester pad will attach and hold on for security. The scouring pad can also be cut to match the tool face. Other possible attachment methods include a drawstring apparatus, in which the scouring pad is secured to a flexible backup pad to form a scouring assembly. This particular arrangement is described in U.S. Pat. No. 5,183,000.

Examples of power equipment used in the process are the Random Orbit Polisher No. 9555, manufactured by Black & Decker, Inc, Towson, Md.; a one/quarter inch drill, Model 6501 equipped with a sander head; and a Random Orbit Sander, Model B05000, both manufactured by Makita Corporation, Buford Ga.

In use, the scouring assembly is mounted to the portable, hand operated power tool and a small amount of abrasive composition of the invention, described below, is applied to the center of the scouring pad. The whole assembly is placed on the mirrored glass. At this time, the scouring pad applied to the glass in a rotary motion imparted by the power tool. It is important to keep the work area moist at all times, so therefore the glass must be wet or partially wet. By applying the abrasive composition first to the scouring assembly and then using the rotary motion when the pad is in contact with the work surface, the abrasive composition is prevented from being thrown away from the work surface.

The tool is worked in a circular motion and if the abrasive composition begins to dry while being worked, more abrasive composition or liquid is added to the surface to prevent drag on the surface which may cause heat to build up, possibly cracking or damaging the mirrored surface. It is necessary to stop the removal process from time to time to check one's progress. The abrasive is periodically removed from the surface with, for example, a rubber squeegee or absorbent cloth. If more deposit needs to be removed from the surface, the above steps are repeated.

The final step in the preferred process is to protect the clean surface with a transparent polymer coating. Exemplary polymers are similar to the product manufactured by Unelko Corporation, Scottsdale Ariz., under the tradename "TPC®". This material is a silicone polymer base that includes ethyl alcohol and isopropyl alcohol. This and similar products give the surface a thin coating which keeps the minerals from adhering to the surface, thus making regular maintenance easier because the minerals are bonded to the polymer and not to the glass.

A method of the invention for removing mineral deposits from a surface that has already been coated with such a protective polymer coating includes applying the composition of the invention directly to the scouring pad and scrubbing the surface until all of the minerals are removed. One's progress is checked by removing the cleaning composition, as described above. Power equipment may not be needed on a surface that is coated with transparent polymer.

Compositions of the invention for use in the above method preferably include pumice-type abrasive cleaners, although commercial polishing and rubbing compounds that are used in the automotive and other industries may be used as well. Nevertheless, since produce and other foods come in contact with mirrors and supermarket cases, it is most preferred that the medium containing the abrasive be authorized by the United States Department of Agriculture for use as a general cleaning agent on all surfaces or for use with mechanical cleaning devices. Such U.S.D.A. materials fall into category A-1.

A particularly preferred example of solution meeting this U.S.D.A. criteria are solutions made by Industrial Chemical Laboratories, Inc., 1015 North 14th Street, Omaha, Nebr., under the name of "Enviro Care Food Service Cleaner". This material is stable, biodegradable, non-toxic, is not a fire hazard, and will not support combustion Examples of abrasives that are most preferably used in combination with such a U.S.D.A. approved cleaner are ground pumice stone, iron oxide, calcium carbonate, aluminum oxide and diatomaceous earth. A wide variety of particulate sizes can be used in suspensions of the abrasive materials, although the most preferred size of abrasive is between about three to five microns.

In addition, the preferred compositions are acidic, having a pH not greater than 7.0, and most preferably between pH 2 to about 4. An exemplary cleaner composition having a pH of approximately 2 includes: 30 ml water; 2 ml citric acid (anhydrous, granular); 6 ml pumice powder (fine); and 30 ml talc powder. Other acids such as phosphoric and nitric acid may be used to provide the appropriate acidity but these are less preferred than citric acid which is milder and less toxic to the operator and to the produce. The mixture of pumice and suspending fluid are combined together to the consistency of putty and then applied to the scouring pad, as described above. Another exemplary formulation includes a mixture of a one pound of pumice stone ("FF" grade; manufactured by Empie Blended Products, Inc., 250 Hickory Lane, Bayville, N.J. ) to six ounces of Enviro Care Food Service cleaner.

If necessary, immediately after the work surface has been cleaned, a solution, such as any commercially available quaternary ammonium solution, is applied to the work surface. Exemplary formulations of this type may be obtained from Candy/Peck's products, 2515 West 35th Street, Chicago, Ill. 60632, under the tradename "Sanitizer".

The method of the present invention is found to be effective in removing mineral deposits from surfaces, especially mirrored glass surfaces of supermarket produce cases. The present method is proven to be both effective and to provide a distinct safety advantage by avoiding the use of cleaners harmful to foods.

EQUIVALENTS

Those skilled in the art will recognize, or be able to ascertain using no more than routine experimentation, many equivalents to the specific embodiments of the invention described specifically herein. Such equivalents are intended to be encompassed in the scope of the following claims.

What is claimed is:

1. A method for cleaning a glass surface of a mirror, comprising:

affixing a pad to a portable, power tool having means for engaging the pad;

applying a composition having a pH less than 7.0 and containing an abrasive to the pad;

applying the pad to the glass surface;

operating the tool in a rotary motion at high speed until the glass surface is clean; and removing excess composition from the glass surface.

2. The method of claim 1, wherein affixing a pad comprises affixing a scouring pad.

3. A method of claim 2, wherein affixing the scouring pad comprises affixing the pad to the power tool using a Velcro attachment.

4. A method of claim 1, wherein the operating comprises operating a power tool having a rotary motion ranging from between about 9,000 to about 13,000 revolutions per minute.

5. A method of claim 1, wherein applying an acid composition comprises applying a composition having a pH of about 4.0, wherein the composition contains an abrasive selected from the group consisting of ground pumice stone, calcium carbonate, aluminum oxide, and diatomaceous earth.

6. The method of claim 5, wherein the abrasive has a particle size between about 3 to about 5 microns.

7. The method of claim 1, wherein applying an acidic composition comprises applying a composition comprising:

a non-toxic, biodegradable solution having a pH less than 7 in combination with an abrasive selected from the group consisting of ground pumice stone, calcium carbonate, aluminum oxide, and diatomacious earth.

8. The method of claim 1 wherein applying an acidic composition comprises applying a composition comprising an aqueous solution of citric acid, pumice powder and talc in an amount sufficient to provide an abrasive composition having a consistency of putty.

* * * * *